US011825950B2

(12) United States Patent
Wang

(10) Patent No.: US 11,825,950 B2
(45) Date of Patent: Nov. 28, 2023

(54) SOFA FRAME AND ASSEMBLED SOFA

(71) Applicant: Chang You Wang, Dongguan (CN)

(72) Inventor: Chang You Wang, Dongguan (CN)

( * ) Notice: Subject to any disclaimer, the term of this patent is extended or adjusted under 35 U.S.C. 154(b) by 0 days.

(21) Appl. No.: 17/731,263

(22) Filed: Apr. 28, 2022

(65) Prior Publication Data

US 2022/0346561 A1 Nov. 3, 2022

(30) Foreign Application Priority Data

Apr. 29, 2021 (CN) ..... 202120912001.9

(51) Int. Cl.
*A47C 17/86* (2006.01)

(52) U.S. Cl.
CPC ..... *A47C 17/86* (2013.01)

(58) Field of Classification Search
CPC ..... A47C 17/86; A47C 17/00; A47C 4/028; A47C 4/02; A47C 13/005
USPC ..... 297/440.15
See application file for complete search history.

(56) References Cited

U.S. PATENT DOCUMENTS

| | | | | |
|---|---|---|---|---|
| 9,668,581 | B1 * | 6/2017 | Hill | A47C 17/04 |
| 2005/0225153 | A1 * | 10/2005 | Ou | A47C 17/00 297/440.14 |
| 2012/0212021 | A1 * | 8/2012 | Hunter | A47C 4/028 53/399 |
| 2017/0071354 | A1 * | 3/2017 | Mezzera | A47C 4/028 |
| 2021/0153658 | A1 * | 5/2021 | Kim | A47C 17/04 |
| 2021/0169230 | A1 * | 6/2021 | Hutmacher | A47C 17/1753 |
| 2021/0267378 | A1 * | 9/2021 | Ozturk | A47C 17/165 |

FOREIGN PATENT DOCUMENTS

EP 2868234 * 5/2015

* cited by examiner

*Primary Examiner* — Mark R Wendell

(57) ABSTRACT

Sofa frame and assembled sofa, comprising back boards, side boards connected to back boards, and face board connected to side boards; said side boards are relatively configured on the two sides of the back board; the two sides of the face board are respectively connected to the side boards on both sides; said face board comprises at least two folding blocks and hinges connected to the folding blocks. In the above-mentioned sofa frame, as hinges are used to connect adjacent folding blocks, the face board becomes a folding structure. Thus, during transportation, the folded face board occupies less space to reduce transportation cost.

10 Claims, 3 Drawing Sheets

SOFA FRAME AND ASSEMBLED SOFA

BACKGROUND OF INVENTION

1. Field of the Invention

The present invention relates generally to the field of sofa, and more particularly to sofa frame and assembled sofa.

2. Description of Related Art

A sofa is a multi-seat chair installed with soft cushion. As a kind of soft furniture, it is a necessity for modern families. Being an armchair installed with springs or thick foams with armrests on both sides, it can be used for leisure and relief of fatigue.

At present, most sofa products are assembled structures. Inside the sofa, there is a face board having the length of the sofa. This board occupies a lot of space and is not convenient for transportation. As a result, the transportation cost is high.

SUMMARY OF THE INVENTION

Based on this, it is necessary to develop a sofa frame and assembly sofa to solve the old problem.

A sofa frame, comprising: back boards; side boards, connected to the back boards, the side boards being configured on both sides of the back boards; and a face board, connected to the side boards, the two sides of the face board respectively connected to the side boards on both sides; the face board comprises at least two folding blocks and hinges connected to the folding blocks.

More particularly, wherein the hinges are configured on the side of the folding blocks away from the back boards.

More particularly, wherein the side of the face board away from the back boards is provided with an outer cover.

More particularly, wherein the sofa frame comprises a reinforcing rib; the two ends of the reinforcing rib are respectively connected to the back boards and the face board.

More particularly, wherein the reinforcing rib comprises a supporting portion and connecting portions connected to the supporting portion; the connecting portions are relatively configured on the two ends of the supporting portion, the connecting portions are respectively connected to the back boards and the face board.

More particularly, wherein the supporting portion is in the shape of "n".

More particularly, wherein the reinforcing rib is configured with an upright post, the upright post being cylindrical, the end of the upright post being in threaded connection with the reinforcing rib.

An assembled sofa, comprising: the sofa frame defined in claim 1, a support board mounted between the back board and the face board, a back cushion installed on the back board and a seat cushion installed on the support board; the back board is configured with an abutting block; the two ends of the support board respectively prop against the abutting block and the face board.

More particularly, wherein the back cushion is filled with synthetic fiber, the seat cushion is filled with sponge, the back cushion and seat cushion being vacuum compressed during packing.

More particularly, which further comprises leg supports, the leg support including a bottom block and foot pads connected to the bottom block.

More particularly, wherein the hinges are configured at the side of the folding blocks away from the back boards; the side of the face board away from the back boards is provided with an outer cover.

More particularly, wherein the sofa frame further comprises an reinforcing rib; the two ends of the reinforcing rib are respectively connected to the back boards and face board; the reinforcing rib comprises a supporting portion and connecting portions connected to the supporting portion; the connecting portions are arranged on the two sides of the supporting portion, opposite each other, and the connecting portion are respectively connected to the back boards and the face board.

More particularly, wherein the supporting portion is in the shape of "n".

More particularly, wherein the reinforcing rib is configured with an upright post, the upright post being cylindrical, and the end of the upright post is in threaded connection with the reinforcing rib.

Benefits of the Present Invention:

In the sofa frame of the invention, hinges are used to connect the adjacent folding blocks, so that the face board becomes a folding structure to reduce the space of occupation during transportation, and to reduce the overall transportation cost. Through the present invention, the sofa product will be able to meet the U.S. requirement set out in the size calculation guideline for assembled sofa mail orders, that is, the length of packing shall be no more than 330 cm.

DETAILED DESCRIPTION OF THE INVENTION

Detailed descriptions are provided below with reference to the accompanying figures.

Figure 1:
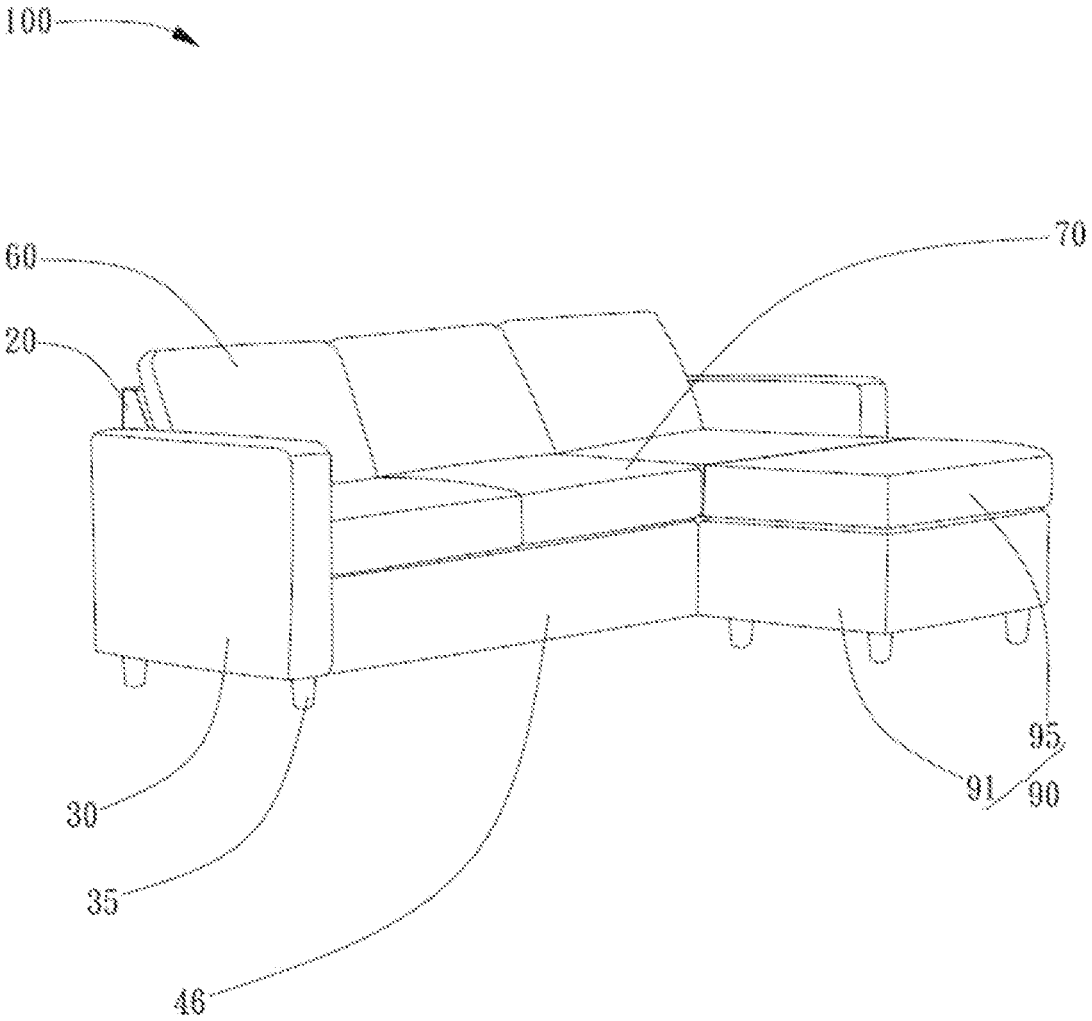
FIG. 1 is a structural view of the assembled sofa according to the invention.
Figure 2:
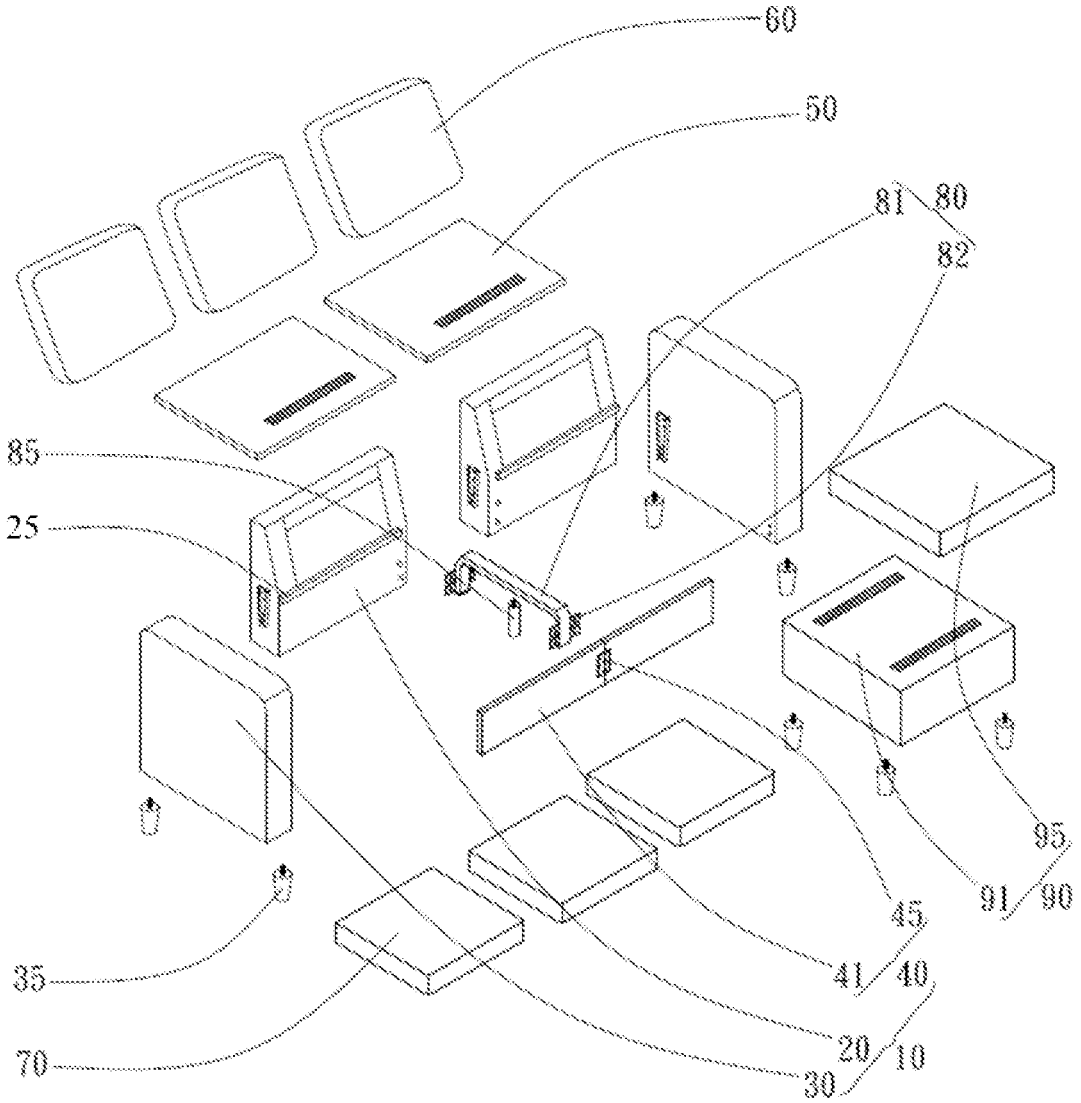
FIG. 2 is an exploded view of the assembled sofa in FIG. 1 with the cover hidden.
Figure 3:
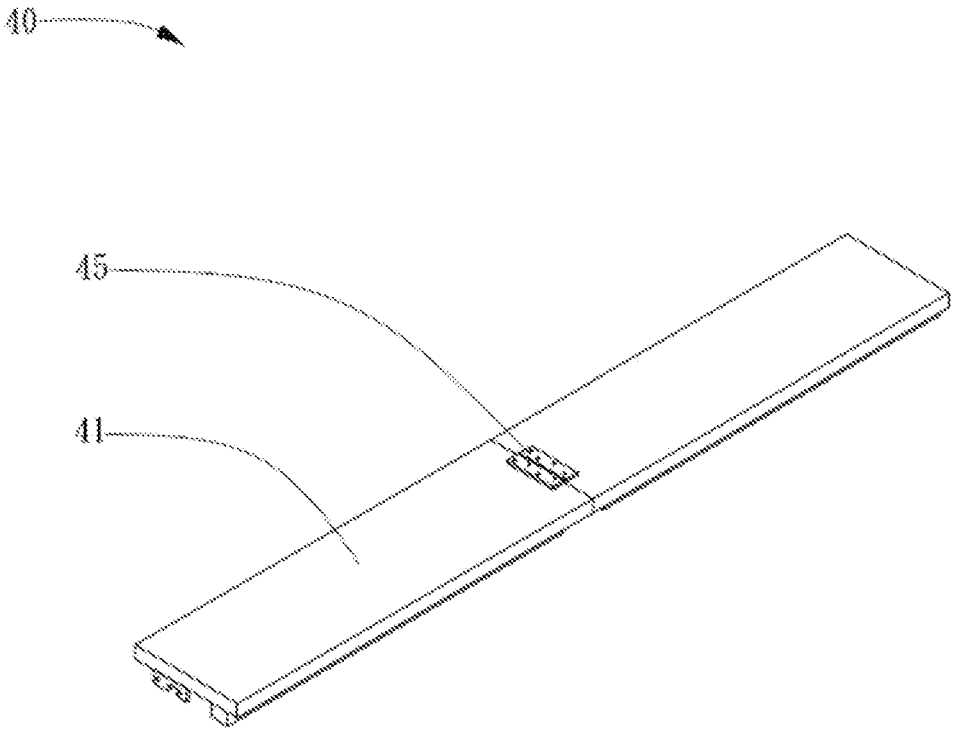
FIG. 3 is a structural view of the face board in FIG. 2.

Depicted in FIG. 1 to FIG. 3 is an assembled sofa 100 according to the invention, which comprises a sofa frame 10, a support board 50 connected to the sofa frame 10, a back cushion 60 and seat cushion 70; the sofa frame 10 is used to support the overall assembled sofa 100. The sofa frame 10 comprises back boards 20, side boards 30 connected to the back boards 20, and face board 40 connected to the side boards 30; the assembled sofa 100 is for people to rest on to release fatigue.

The back board 20 is roughly rectangular, and vertically configured for people to sit and lie. In the present embodiment, the number of back boards 20 provided is two, arranged in parallel. The two back boards 20 are connected and fixed with each other on one side. Further, the back boards 20 are configured with an abutting block 25, in a long shape, configured on one side of the back board 20 in the horizontal direction.

The side boards 30 are connected to the back board 20, and are relatively configured on the two sides of the back board 20, in rectangular shape and vertical arrangement. The direction of the side board 30 is perpendicular to the direction of the 0 back board 20; in the present embodiment, the two back boards 20 are configured between the side boards 30 on both sides. The bottoms of the side boards 30 are further configured with support legs 35. The support legs 35 are roughly in the shape of a cylinder and are vertically arranged. They are in threaded connection with the side boards 30; there are four support legs 35, provided on both sides of the bottom of the two side boards 30.

The face board 40 is connected to the side boards 30. The two ends of the face board 40 are respectively connected to the side boards 30 on both sides. The face board 40 and the back board 20 are relatively configured on two sides of the side board 30; The face board 40 comprises at least two folding blocks 41 and hinges 45 connected to the folding blocks 41. The folding blocks 41 are rectangular straight boards, vertically configured, parallel to the back board 20, and are sequentially arranged at intervals along the direction of the back board 20; the hinges 45 are connected to the two adjacent folding blocks 41, used to enable the two folding blocks 41 to rotate in relation to each other. In the present embodiment, the hinges 45 are metal hinges; there are two folding blocks 41, and the hinges 45 are arranged between the two folding blocks 41. The hinges 45 are configured on the side of folding blocks 41 away from the back board 20. The side of the face board 40 away from the back board 20 is covered by an outer cover 46. The outer cover 46 is covered outside the hinges 45. The outer cover 46 is used to improve appearance. As the outer cover 46 is covered outside the hinges 45, the face boards 40 must be folded toward the outer cover 46 to avoid damage to the outer cover 46 in case they are folded in the direction away from the outer cover 46. The outer cover 46 is a cloth cover or a cover made of other materials.

The support board 50 is mounted between the back board 20 and the face board 40. The support board 50 is a rectangular straight board, arranged horizontally, with its two ends respectively abutting the abutting block 25 and the face board 40. There are two support boards 50, arranged to match the two back boards 20. The two support boards 50 are parallel to each other.

The sofa frame 10 also comprises a reinforcing rib 80. The two ends of the reinforcing rib 80 are respectively connected to the back board 20 and the face board 40. The reinforcing rib 80 is positioned to correspond to the hinges 45. The reinforcing rib 80 is used to enhance the anti-bending property of the face board 40, so as to enhance the reliability of the assembled sofa 100. In the present embodiment, the reinforcing rib 80 includes a supporting portion 81 and a connecting portion 82 that is connected to the supporting portion 81; the supporting portion 81 is in the shape of "n", vertically arranged at the hinge position of the two folding blocks 41. The bottom of the supporting portion 81 is supported by the ground; the connecting portion 82 is relatively configured on the two ends of the supporting portion 81. The connecting portion 82 is respectively connected to the back board 20 and the face board 40, so as to fix the supporting portion 81 between the back board 20 and the face board 40. The connecting portion 82 is a rectangular block, extending in opposite directions from the two sides of the supporting portion 81, so as to make sure the connecting portion 82 is connected to the two back boards 20, and the two folding blocks 41 to enhance strength. The reinforcing rib 80 is configured with an upright post 85, in a cylindrical shape and vertically arranged. Its end portion is in threaded connection with the reinforcing rib 80. The upright post 85 is extended from the reinforcing rib 80 toward the direction away from the support board 50, and contacts the ground at the end away from the reinforcing rib 80.

The back cushion. 60 is mounted on the back board 20. The back cushion 60 is rectangular, with its inside filled with sponge or other elastic materials that provides comfort when people lies on it. In the present embodiment, the back cushion 60 is filled with synthetic fiber, and vacuum compressed during packing.

The seat cushion 70 is mounted on the support board 50. The seat cushion 70 is rectangular and horizontally arranged. The inside of the seat cushion 70 is filled with sponge or other elastic materials that can improve comfort. In the present embodiment, the seat cushion 70 is filled with sponge, and vacuum compressed during packing.

The assembled sofa 100 further comprises a leg support 90. The leg support 90 is used to support the leg of the user, so that the body, can lie on the assembled sofa 100; the leg support 90 includes a bottom block 91 and a foot pad 95 connected to the bottom block 91. The bottom block 91 is a rectangular block, vertically arranged; the foot pad 95 is rectangular, arranged in the horizontal direction. The foot pad 95 is mounted on the top of the bottom block 91. The foot pad 95 is filled with sponge or other elastic materials, to improve comfort for the legs placed on it. In the present embodiment, corresponding support legs 35 are configured under the bottom block 91. The support legs 35 are in threaded connection with the bottom block 91, and are configured at the four corners of the bottom side of the bottom block 91.

In the above-mentioned sofa frame 10, hinges 45 are used to connect the adjacent folding blocks 41, so that the face board 40 becomes a folding structure to reduce space occupation of the folded face board 40 during transportation, thus reducing the transportation cost. Through the present invention, the sofa product will be able to meet the United States requirement set out in the size calculation guideline for assembled sofa mail orders, that is, the length of packing shall be no more than 330 cm.

I claim:

1. A sofa frame, comprising:

back boards;

side boards, connected to the back boards, the side boards being configured on both sides of the back boards; and a face board, connected to the side boards, the two sides of the face board respectively connected to the side boards on both sides; the face board comprises at least two folding blocks and hinges connected to the folding blocks;

wherein the sofa frame comprises a reinforcing rib; the two ends of the reinforcing rib are respectively connected to the back boards and the face board;

wherein the reinforcing rib is configured with an upright post, the upright post being cylindrical, the end of the upright post being in threaded connection with the reinforcing rib.

2. The sofa frame defined in claim 1, wherein the hinges are configured on the side of the folding blocks away from the back boards.

3. The sofa frame defined in claim 2, wherein the side of the face board away from the back boards is provided with an outer cover.

4. The sofa frame defined in claim 1, wherein the reinforcing rib comprises a supporting portion and connecting portions connected to the supporting portion; the connecting portions are relatively configured on the two ends of the supporting portion, the connecting portions are respectively connected to the back boards and the face board.

5. The sofa frame defined in claim 4, wherein the supporting portion is in the shape of "n".

6. An assembled sofa, comprising: the sofa frame defined in claim 1, a support board mounted between the back board and the face board, a back cushion installed on the back board and a seat cushion installed on the support board; the back board is configured with an abutting block; the two ends of the support board respectively prop against the abutting block and the face boards;

wherein the sofa frame further comprises an reinforcing rib; the two ends of the reinforcing rib are respectively connected to the back boards and face board; the reinforcing rib comprises a supporting portion and connecting portions connected to the supporting portion; the connecting portions are arranged on the two sides of the supporting portion, opposite each other, and the connecting portion are respectively connected to the back boards and the face board;

wherein the reinforcing rib is configured with an upright post, the upright post being cylindrical, and the end of the upright post is in threaded connection with the reinforcing rib.

7. The assembled sofa defined in claim 6, wherein the back cushion is filled with synthetic fiber, the seat cushion is filled with sponge, the back cushion and seat cushion being vacuum compressed during packing.

8. The assembled sofa defined in claim 6, which further comprises leg supports, the leg support including a bottom block and foot pads connected to the bottom block.

9. The assembled sofa defined in claim 6, wherein the hinges are configured at the side of the folding blocks away from the back boards; the side of the face board away from the back boards is provided with an outer cover.

10. The assembled sofa defined in claim 6, wherein the supporting portion is in the shape of “n”.

* * * * *